US009631333B1

(12) United States Patent
Chase

(10) Patent No.: US 9,631,333 B1
(45) Date of Patent: Apr. 25, 2017

(54) RESERVOIR SHADING APPARATUS AND METHOD

(71) Applicant: Sydney Chase, Glendora, CA (US)

(72) Inventor: Sydney Chase, Glendora, CA (US)

( * ) Notice: Subject to any disclaimer, the term of this patent is extended or adjusted under 35 U.S.C. 154(b) by 0 days.

(21) Appl. No.: 15/072,355

(22) Filed: Mar. 17, 2016

(51) Int. Cl.

| | |
|---|---|
| ***B65D 88/34*** | (2006.01) |
| ***E02B 1/00*** | (2006.01) |
| ***B65D 1/02*** | (2006.01) |
| ***B65D 41/04*** | (2006.01) |
| ***E04H 4/08*** | (2006.01) |

(52) U.S. Cl.
CPC ..... *E02B 1/00* (2013.01); *B65D 1/0207* (2013.01); *B65D 41/0407* (2013.01); *B65D 88/34* (2013.01); *E04H 4/08* (2013.01)

(58) Field of Classification Search
CPC ..... B65D 88/36; B65D 90/06; B65D 90/42; B65D 88/34; B65D 1/0207; B65D 41/0407; E02B 1/00; A01C 3/028
USPC ..... 215/40
See application file for complete search history.

(56) References Cited

U.S. PATENT DOCUMENTS 3,401,818 A * 9/1968 Reinhold ..... B65D 88/36 220/216
3,462,040 A * 8/1969 Galloway ..... B65D 88/34 220/218
3,938,338 A * 2/1976 Cullen ..... B01J 19/16 220/216
3,998,204 A * 12/1976 Fuchs ..... B65D 88/36 126/565
5,188,550 A * 2/1993 Oliver ..... F24J 2/0472 126/567
7,387,473 B2 * 6/2008 Smith ..... B65D 88/36 405/303
8,029,208 B1 * 10/2011 Lee ..... E04H 4/08 405/63
9,249,548 B1 * 2/2016 Mitzen ..... E02B 3/00
2007/0275616 A1 * 11/2007 Burston ..... E03B 11/00 441/136
2008/0000903 A1 * 1/2008 Cap ..... B65D 88/36 220/216
2015/0000182 A1 * 1/2015 Gomez ..... A01M 1/2016 43/122

* cited by examiner

*Primary Examiner* — John Kreck
*Assistant Examiner* — Carib Oquendo
(74) *Attorney, Agent, or Firm* — Edwin Tarver; Lauson & Tarver, LLP

(57) ABSTRACT

A reservoir shading structure made of multiple consumer beverage containers. The containers each have a bottle portion, and a top portion preferably with a collar. The top portion is removed, inverted, and replaced in the bottle portion to extend into the bottle portion. The top portion is hermetically sealed to the bottle portion and a cap is welded into the top portion to hermetically seal the consumer beverage container. The consumer beverage containers are UV resistant, made of NSF/ANSI Rule 61 compliant material, and may include carbon black in their construction. Multiple consumer beverage containers are placed in a uniform layer across the surface of the reservoir to form a shading structure that reduces evaporation and microbial growth.

20 Claims, 5 Drawing Sheets

RESERVOIR SHADING APPARATUS AND METHOD

BACKGROUND

Field of the Invention

The present invention generally relates to reservoir water conservation. More specifically, the present invention relates to floatation-based reservoir water shading apparatus to prevent, evaporation and microbial contamination.

State of the Prior Art

Reservoirs of various sizes are used by public and private entities for water storage and providing potable water to end users. Although most modern designs involve enclosed or covered structures to prevent water contamination and evaporation, these systems are expensive to construct and maintain, and therefore beyond the reach of entities unable to pay for them. Consequently the majority of reservoirs still in use globally are traditional, uncovered structures mimicking a lake or similar body of water, and consequently subject to environmental influences.

Since reservoir water remains relatively still it serves as a suitable environment for algae and microbial growth. Exposure to sunlight, particularly in a warm climate, leads to excessive microbial growth, making remediation and treatment difficult and expensive. Prolonged exposure to sight also leads to disfavored chemical reactions, such as the generation of bromated carcinogens. It also causes evaporative loss. Evaporative loss reduces the quantity of water available to end users, and concentrates harmful chemicals and microbes in the remaining water. Globally, more water evaporates from reservoirs than is consumed by humans, Covering open-air reservoirs is thus an effective way of mitigating microbial and chemical contamination, and water loss from sunlight exposure.

One method of covering reservoirs involves the use of numerous floating opaque objects, including tarps, cement casings, foam floats, or floating spheres. Spheres are more popular due to their ability to roll on the surface of the water and move around without causing gaps. These spheres, typically in the thousands, are hollow and sealed. Although they form an effective cover for reservoirs, considerable resources are used to manufacture them. Also, spheres currently in the art frequently leak over time which alters their buoyancy and effectiveness.

Consumer beverage containers (CBCs) account for a large portion of landfill mass. Although usually recyclable, these containers are frequently discarded rather than recycled. Approximately fifty million CBCs make their way into landfills each year. There are few resources available for reducing the number of CBCs not recycled.

Thus there is a need for an effective reservoir cover that operates in the same manner as floating spheres, but which avoids the need for independently manufacturing thousands of such spheres. There is also a need for a way of reducing the number of discarded CBCs that make their way into landfills. There is also a need for a floating shade reservoir covering system that avoids the problems of ineffective sealing, leakage and altered buoyancy. These needs are solved by providing a CBC-based floating shade reservoir cover as shown and described.

SUMMARY

A reservoir shading structure includes multiple consumer beverage containers, each having a bottle portion for holding a beverage and a top portion for decanting the beverage, The top portion, having a collar, among other structures. The top portion is removed from the bottle portion, inverted, and replaced in the bottle portion, such that top portion extends into the bottle portion. The top portion is then hermetically sealed to the bottle portion and a cap (which may be the cap of the consumer beverage container) is welded into the top portion to render the consumer beverage container permanently hermetically sealed. Multiple consumer beverage containers are placed in a uniform layer across the surface of the reservoir forming a shading structure to reduce evaporation and microbial growth therein.

In addition to having a collar, the top portion may be threaded. Preferably the top portion is heat sealed to the bottle portion. In one embodiment, the collar is heat sealed to the bottle portion, and the cap is spin welded to a threaded area of the top portion. In order to survive long periods of sun exposure, the consumer beverage container may be made from a UV resistant material. To avoid leaching adverse chemicals into the reservoir, the consumer beverage container is preferably made of a NSF/ANSI Rule 61 compliant material, The consumer beverage container may also incorporate carbon black into its construction.

A method is also disclosed for conserving water in a reservoir and avoiding chemical and microbial contamination. The method includes the steps of obtaining a consumer beverage container having a bottle portion for holding, a beverage and a top portion for decanting the beverage. A cut line under a collar on the to portion is identified and the consumer beverage container is cut along the cut line. The top portion is inverted and inserted into the bottle portion such that the collar is brought adjacent the bottle portion. Then the top portion is hermetically sealed to the bottle portion. Alternatively, the top portion of the bottle can be heated and simply pressed down into the bottle portion. A cap is spin-welded into the top portion, thereby sealing the consumer beverage container, and multiple consumer beverage containers in a uniform layer across the surface of a reservoir, thereby creating a shading structure reducing evaporation and microbial growth.

In various embodiments of the method, the consumer beverage container may be procured from among previously used consumer beverage containers. The consumer beverage container may also be prepared for conversion by assembling multiple consumer beverage containers in a modified bottling production line. A ballast, such as water or another heavy material is enclosed in the consumer beverage container to prevent the consumer beverage containers from stacking on top of each other, or blowing away in the wind. The consumer beverage container may be made from a NSF/ANSI Rule 61 compliant material, may incorporate carbon black into its construction, and may comprise a UV resistant material. Other steps may include heat sealing the top portion to the bottom portion, and heat sealing the collar to the bottom portion.

BRIEF DESCRIPTION OF THE FIGS.

DETAILED DESCRIPTION

The following, description is presented to enable any person skilled in the art to make and use the invention, and is provided n the context of a particular application, and its requirements. Various modifications to the disclosed embodiments will be readily apparent to those skilled in the art, and the general principles defined herein may be applied to other embodiments and applications without departing from the spirit and scope of the present invention Thus, the present invention is not limited to the embodiments shown, but is to be accorded the widest scope consistent with the principles and features disclosed, herein.

Figure 1:
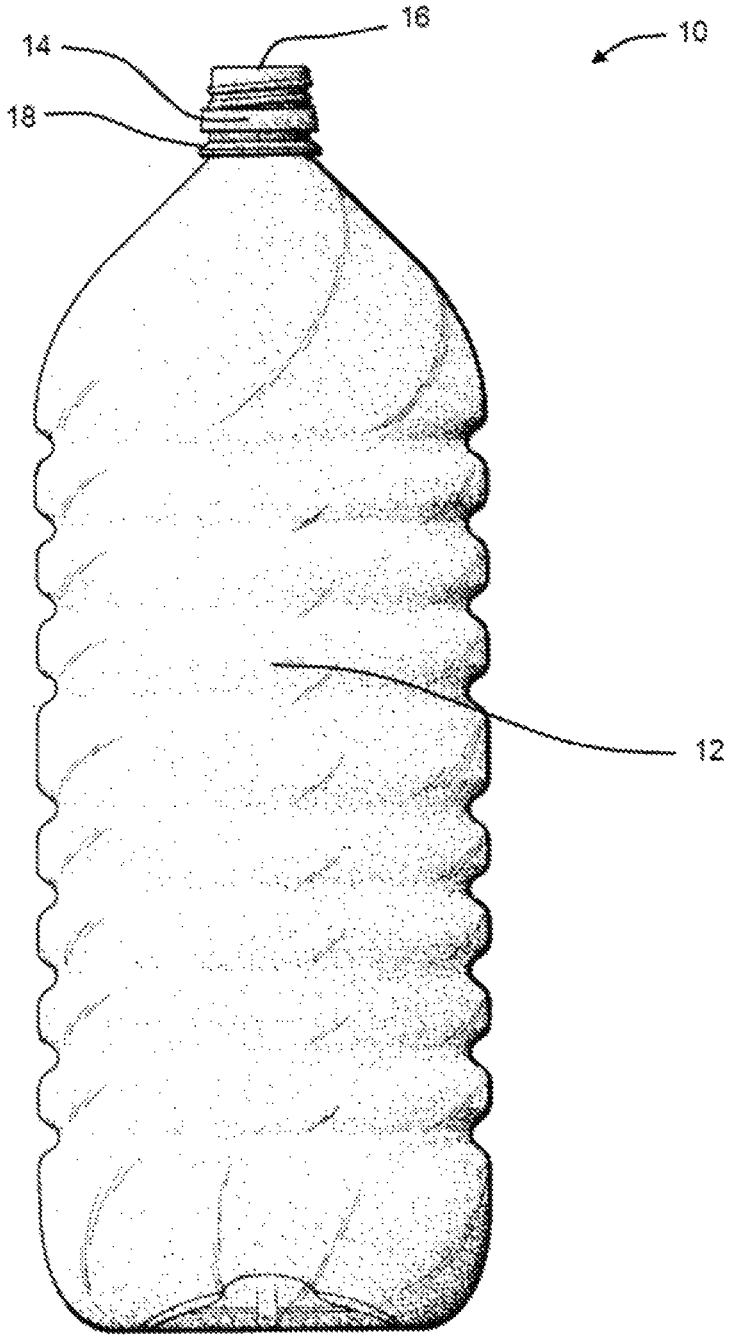
FIG. 1 illustrates a consumer beverage container prior to conversion to a reservoir covering body.

Referring to FIG. 1, a preferred embodiment of the present invention is an apparatus and method of protecting open-air reservoirs while eliminating waste caused by discarded consumer beverage containers (CBCs) 10, typically, but not limited to, water and flavored beverage bottles from eight ounces to two liters in size. CBCs 10 are effective as floats when sealed, and although usually constructed using easily bio- or photo-degradable materials. CBCs 10 can be made from a variety of star plastics, including high-density polyethylene.

Figure 2:
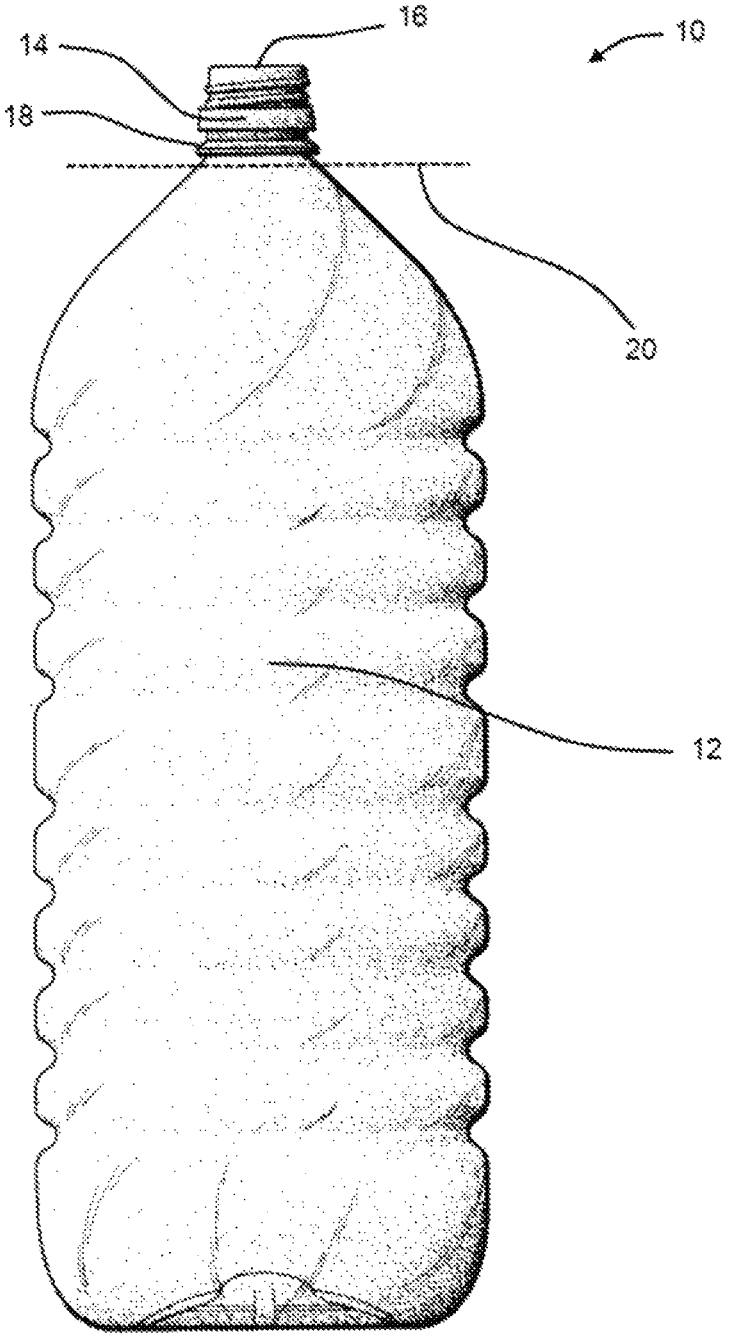
FIG. 2 illustrates the consumer beverage container marked with a cut line.
Figure 3:
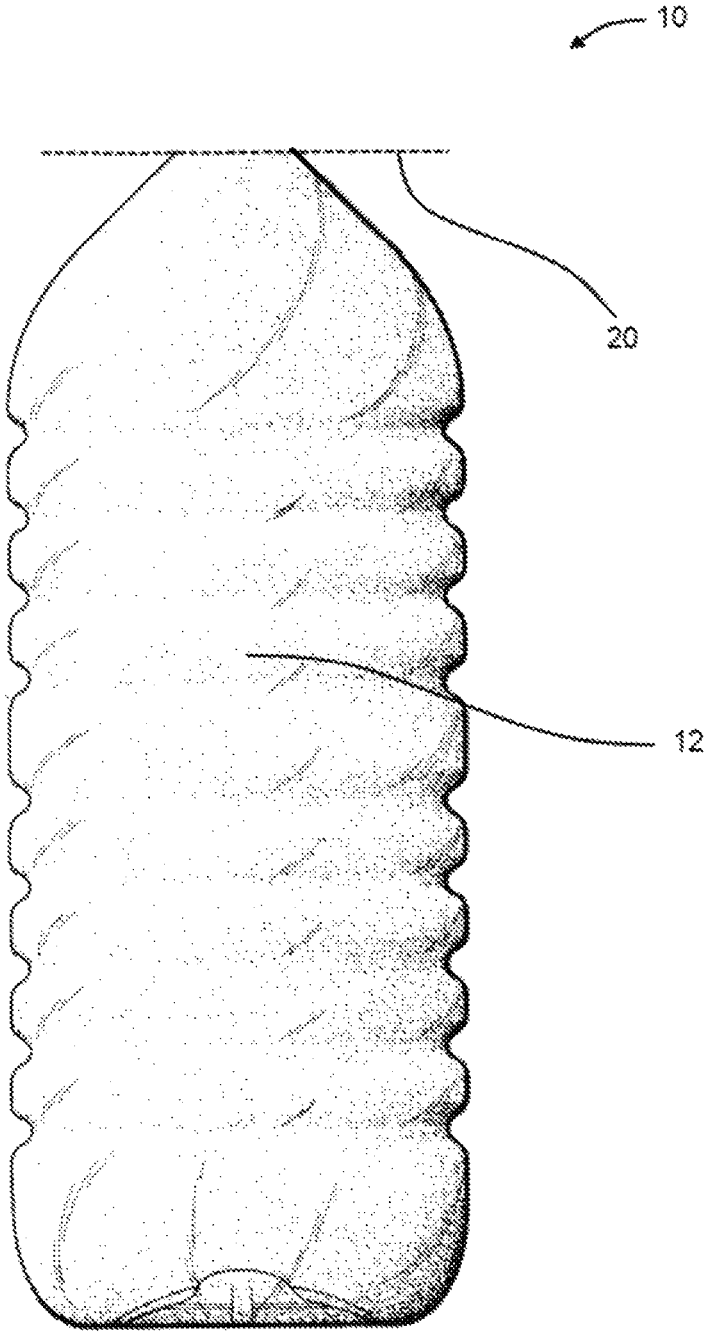
FIG. 3 illustrates the consumer beverage container having been cut to show the removal of the protruding top portion.
Figure 4:
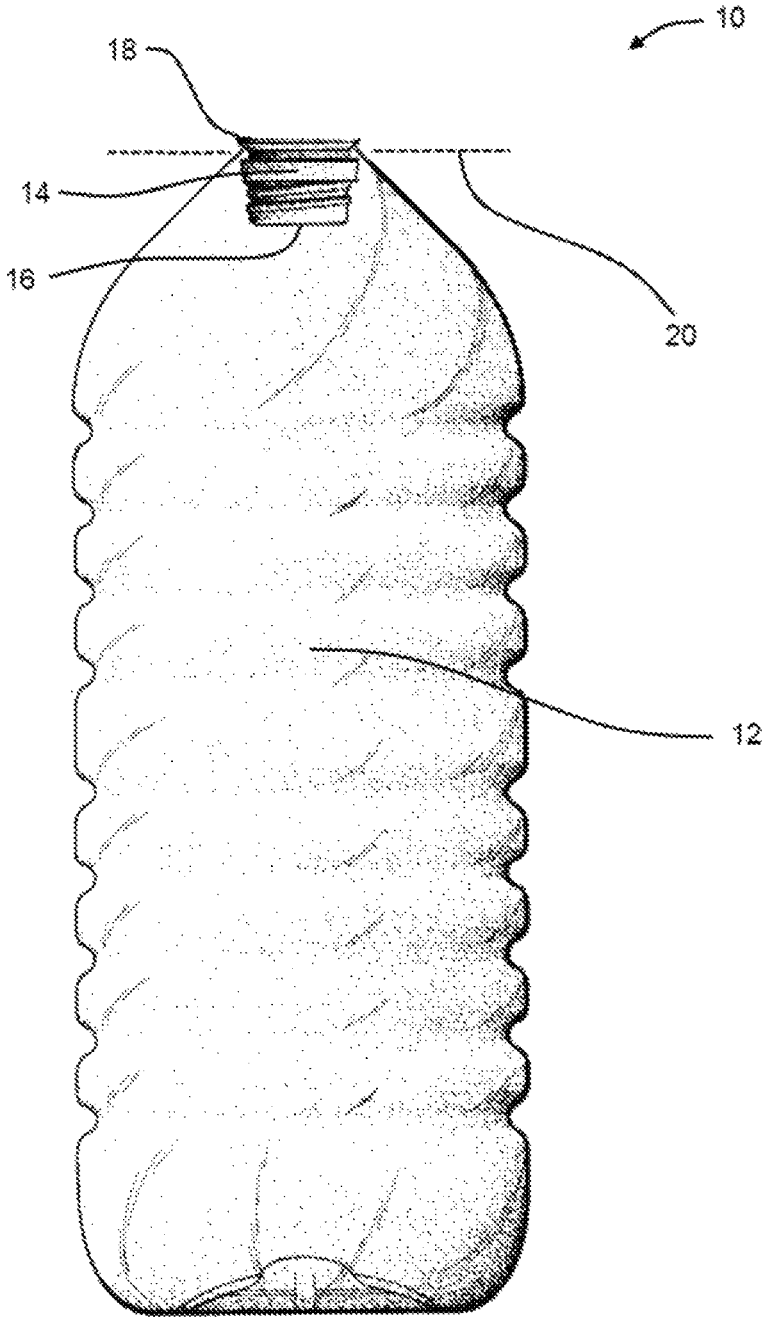
FIG. 4 illustrates the consumer beverage container with the top portion inverted and inserted. into the bottle portion.

Referring to FIGS. 2 and 3, a conventional CBC 10 is shown. The CBC 10 comprises a bottle portion 12 for holding water or similar flavored beverage, and a top portion 14 comprising a threaded opening 16 through which the beverage (not shown) is introduced and consumed. The top portion 14 also includes a collar 18. To prepare the CBC 10 for conversion to a reservoir cover, the top portion 14 is removed from the bottom portion 12 along cut line 20 (FIG. 2) just under the collar 18, Referring to FIG. 4, the top portion 14 with the threaded opening 16 and collar 18 are inverted and pressed with heat into the existing, used (or new) bottle. Since the top portion 14 typically projects from the bottle portion 12, it creates a protruding structure that would interfere with other adjacent CBCs, thereby allowing light to enter the reservoir water, lessening the effectiveness of the cover. With the tap portion 14 inserted into the bottle portion 12 a more rounded profile is created. The top portion 14 is pressed with heat into the bottle portion 12, thereby creating a hermetically sealed structure.

Figure 5:
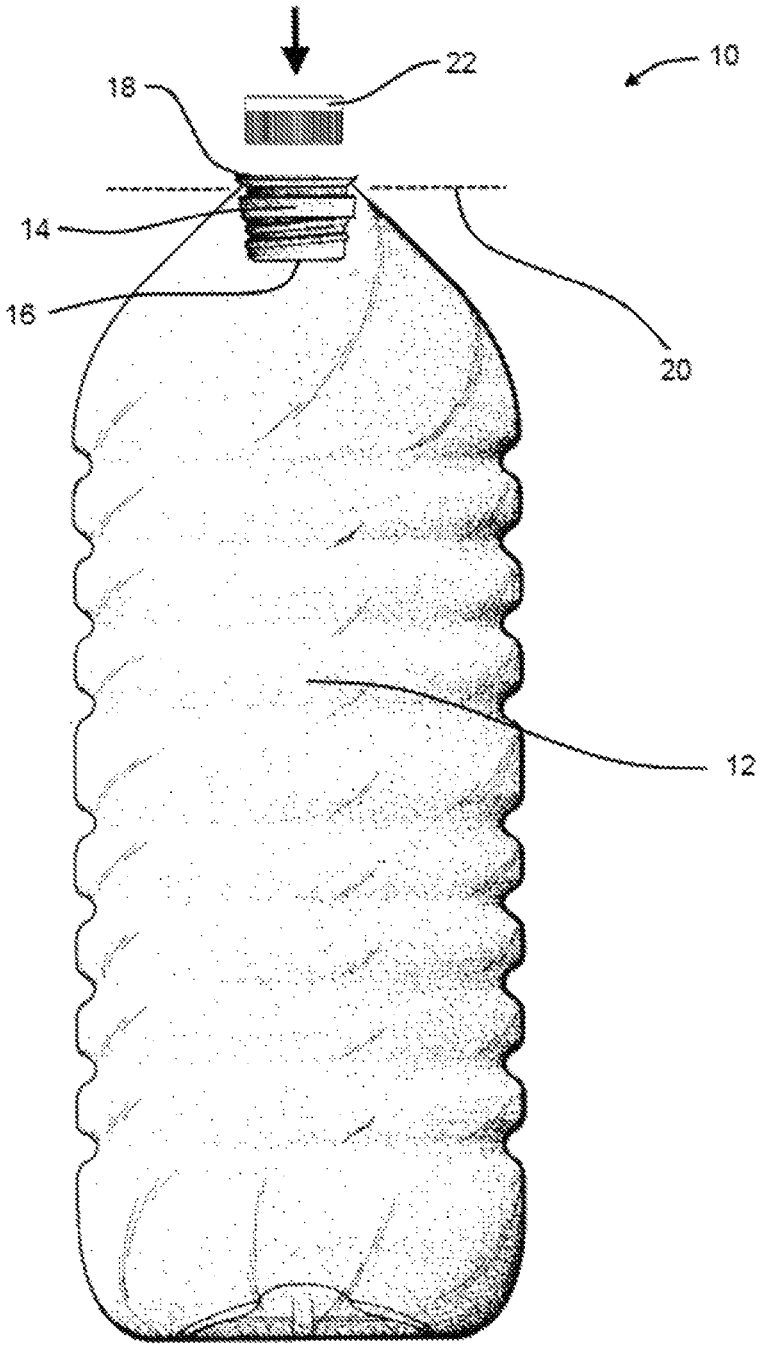
FIG. 5 illustrates the consumer beverage container with an inverted neck and a cap being welded to inverted threads.

Referring to FIG. 5, once the top portion 14 is severed, inverted, inserted in to the bottle portion 12 and hermetically sealed, as cap 22 is spin welded into the top portion 14, thus hermetically scaling the modified CBC 10. In one embodiment, the cap 22 may be from an identical CBC 10 or from the CBC 10 under modification.

In order to survive continued sun exposure, and to avoid leaching endocrine disruptors such as BPA into the water, CBCs 10 intended for recycling into reservoir covers are made from high density polyethylene (HDPE). Preferably the HDPE contains a carbon black primer and a UV inhibitor. Any additional materials comprising the CBCs 10 should be NSF (National Standards Foundation)/ANSI Rule 61 certified (i.e., safe for drinking water). The cap 22 used to seal each CBC 10 is preferably made of the same or a similar NSF/ANSI Rule 61 compliant material.

In one embodiment sealing the bottle occurs after ballasting the bottle to give it an appropriate balanced weight. The balanced weight allows the CBC 10 to roll and helps prevent microbial and algal growth. By incorporating a permanent spin-welded seal, the lifespan of the reservoir cover is extended considerably. By repurposing consumer beverage bottles as reservoir covers, it is estimated that approximately eighty percent of the fifty million bottles thrown into landfills each year can be repurposed. Since The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A reservoir shading structure, comprising:

a liquid container having a bottle portion for holding a liquid and a top portion for decanting the liquid;

the top portion having a collar:

the top portion removed from the bottle portion, inverted, and replaced in the bottle portion, such that the top portion extends into the bottle portion;

the top portion hermetically sealed to the bottle portion; and a cap welded into the top portion to render the liquid container permanently hermetically sealed;

wherein multiple liquid containers placed in a uniform layer across a surface of the reservoir form the shading structure reducing evaporation and microbial growth therein.

2. The structure claim 1 wherein the top portion is threaded.

3. The structure of claim 1 wherein the top portion is heat sealed to the bottle portion.

4. The structure of claim 1 wherein the collar is heat sealed to the bottle portion.

5. The structure of claim 1 wherein the cap is spin welded to a threaded area of the top portion.

6. The structure of claim 1 wherein the liquid container is made from material safe for drinking water.

7. The structure of claim 1 wherein the liquid container comprises carbon black.

8. The structure of claim 1 wherein the liquid container is UV resistant.

9. A method of conserving water in a reservoir and avoiding chemical and microbial contamination, comprising the steps of:

obtaining a consumer beverage container having a bottle portion for holding a beverage and a top portion for decanting the beverage;

identifying a cut line under a collar on the top portion;

heating the consumer beverage container adjacent the cut line;

pressing the top portion into the bottle portion when the consumer beverage container is malleable from heating;

forming a water tight seal between the top portion to the bottle portion;

spin-welding a cap into the top portion, thereby sealing the consumer beverage container; and assembling multiple consumer beverage containers in a uniform layer across a surface of the reservoir, thereby creating a shading structure reducing evaporation and microbial growth.

10. The method of claim 9 including the step of procuring the consumer beverage container from among previously used consumer beverage containers.

11. The method of claim 9 including the step of adding ballast to an interior of the consumer beverage container.

12. The method of claim 9 including the step of obtaining the consumer beverage container made from material safe or drinking water.

13. The method of claim 9 including the step of obtaining the consumer beverage container comprising carbon black.

14. The method of claim 9 including the step of obtaining the consumer beverage container made of a UV resistant material.

15. The method of claim 9 including the step of heat sealing the top portion to the bottom portion.

16. The method of claim 9 including the step of heat sealing the collar to the bottom portion.

17. A reservoir shading structure, comprising:

a consumer beverage container made from material safe for drinking water, and having a bottle portion for holding a beverage and a threaded top portion for decanting the beverage;

the top portion having a collar;

the top portion removed from the bottle portion, inverted, and replaced in the bottle portion, such that the top portion extends into the bottle portion;

the top portion hermetically heat sealed to the bottle portion; and a cap spin into the top portion to render the consumer beverage container permanently hermetically sealed;

wherein multiple consumer beverage containers placed in a uniform layer across a surface of the reservoir form the shading structure reducing evaporation and microbial growth therein.

18. The structure of claim 17 wherein the collar is heat sealed to the bottle portion.

19. The structure of claim 17 wherein the consumer beverage container comprises carbon black.

20. The structure of claim 17 wherein the consumer beverage container comprises a UV resistant material.

* * * * *